United States Patent [19]

Collins

[11] Patent Number: 4,916,364

[45] Date of Patent: Apr. 10, 1990

[54] PARALLEL ARRANGED STARTING CIRCUIT FOR GASEOUS DISCHARGE LAMPS

[75] Inventor: Byron R. Collins, Hendersonville, N.C.

[73] Assignee: General Electric Company, Schenectady, N.Y.

[21] Appl. No.: 224,951

[22] Filed: Jul. 27, 1988

[51] Int. Cl.[4] ..... H05B 41/14

[52] U.S. Cl. ..... 315/290; 315/DIG. 2; 315/DIG. 7

[58] Field of Search ..... 315/289, 290, DIG. 2, 315/DIG. 5, DIG. 7

[56] References Cited

U.S. PATENT DOCUMENTS 4,480,214 10/1984 Sodini ..... 315/290

*Primary Examiner*—David Mis

*Attorney, Agent, or Firm*—John P. McMahon; Stanley C. Corwin; Fred Jacob

[57] ABSTRACT

A starting aid with an autotransformer arranged in a parallel manner with respect to a gaseous discharge lamp is disclosed. The parallel arrangement lowers the current carrying capabilities necessary for the starting aid to handle relative to a serial arrangement. The parallel arranged starting aid by appropriate selection of its component values provides for the application of the starting aid to various sources of alternating current used for the excitation of a variety of types of gaseous discharge lamps.

2 Claims, 1 Drawing Sheet

PARALLEL ARRANGED STARTING CIRCUIT FOR GASEOUS DISCHARGE LAMPS

BACKGROUND OF THE INVENTION

The present invention relates to a starting circuit having a starting aid for gaseous discharge lamps, and more particularly, to a starting aid arranged in parallel across the gaseous discharge lamp.

Starting circuits for gaseous discharge lamps are well known and one such circuit is described in U.S. Pat. No. 4,480,214 issued Oct. 30, 1984. U.S. Pat. No. 4,480,214 discloses a starting circuit having a starting aid arranged in a parallel manner across a gaseous discharge lamp so that the current carrying capabilities of the components of the starting aid are advantageously relatively low when compared to similar circuits arranged in a serial manner with the gaseous discharge lamp. The starting aid of U.S. Pat. No. 4,480,214 utilizes a pulse transformer for the generation of the high voltage pulse necessary to start or restrike the related gaseous discharge lamp. Such a pulse transformer has a disadvantage in that the high voltage pulse developed by its secondary winding along with the impedance of its output stage is loaded and attenuated by its primary winding having its related input stage impedance. It is desired that a starting aid arranged in a parallel manner relative to the gaseous discharge lamp be provided without having the disadvantages yielded by the pulse transformer.

The operational parameters for gaseous discharge lamps are dependent upon the characteristics of the excitation supplying such lamps and it is desirable that the starting aid for such lamps be easily adaptable to such characteristics. For example, it is desirable that the starting aid be easily adaptable to various voltage amplitudes of the applied excitation while still providing the desired voltage to start and maintain the operation of various gaseous discharge lamps.

Accordingly, it is an object of the present invention to provide a parallel arranged starting aid with means that easily adapt the starting aid to various excitations supplying gaseous discharge lamps.

It is a further object of the present invention to provide for a starting aid devoid of a pulse transformer with its inherent loading disadvantages and arranged in a parallel manner with the gaseous discharge lamp.

SUMMARY OF THE INVENTION

The present invention is directed to a starting aid with an autotransformer arranged in a parallel manner with gaseous discharge lamp.

The starting aid comprises an autotransformer, a charging capacitor, a semiconductive switching device, and a resistor-capacitor (RC) network. The autotransformer has one end connected to an inductance means, which, in turn, is connected to one end of a source of alternating current (a.c.). The other end of the autotransformer is connected to one end of the semiconductor switching device. The charging capacitor has one end connected to a tap separating the primary and secondary windings of the autotransformer and its other end connected to the other end of the semiconductor switching device forming a node therebetween.

In the operation of the starting aid, the voltage of the alternating source is allowed to charge up the charging capacitor. Once the charging capacitor reaches a certain potential, corresponding to the threshold or breakover potential of the semiconductor switching device, the semiconductor device is rendered conductive and causes the energy stored in the charging capacitor to be discharged into the secondary winding of the autotransformer, which, in turn, causes a high voltage signal or pulse to be developed and applied to the gaseous discharge lamp so as to initiate the starting thereof.

DETAILED DESCRIPTION OF THE PREFERRED EMBODIMENTS

Figure 1:
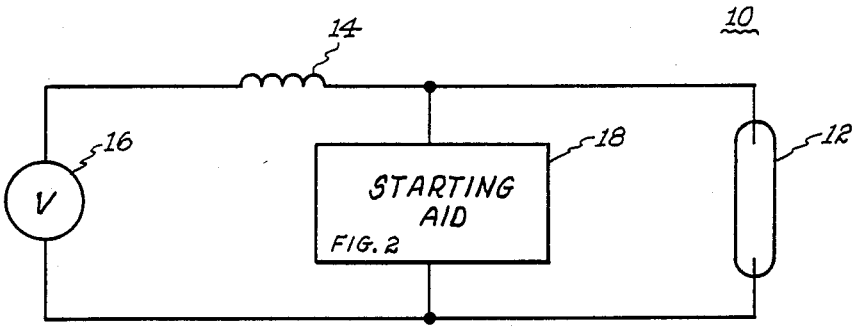
FIG. 1 is a schematic drawing of a starting circuit in accordance with the present invention.

FIG. 1 is a schematic of a starting circuit 10 for a gaseous discharge lamp 12 in accordance with the present invention. The starting circuit 10 comprises an inductive means 14 having one end capable of being connected to one end of a source of alternating current (a.c.) 16 with a value of about 120 volts or about 208 volts, and a starting aid 18. The inductive means 14 may be of a value in a typical range from 80 to 330 millihenries or of a value in a wider range from 50 to 500 millihenries.

The gaseous discharge lamp 12 may be of various types such as a high or low pressure sodium vapor lamp or a metal halide lamp. The various types of lamps desire particular parameters for their initiating or starting which are accommodated by the starting aid 18 that is connected across lamp 12. Starting aid 18 has one end connected to one end of the inductance means 14 along with one end of gaseous discharge lamp 12, and its other end capable of being connected to the other end of the source of alternating current 16 along with the other end of gaseous discharge lamp 12. The starting aid 18 is shown in more detail in FIG. 2.

The starting aid 18 comprises an autotransformer 20, a charging capacitor 22, a semiconductive switching device 24, and a resistor capacitor (RC) network 26 consisting of a selectable resistor network 28 and a capacitor 30. The selectable resistor network 28 comprises resistors 32 and 34.

The autotransformer 20 has a first $\mathbf{20}_A$ and a second $\mathbf{20}_B$ winding each with their related polarity marking indicated by a dot and such windings being serially arranged each with one end separated by a tap $\mathbf{20}_C$. The first winding $\mathbf{20}_A$ serves as the primary winding, whereas, the second winding $\mathbf{20}_B$ serves as the secondary winding. The second winding $\mathbf{20}_B$ has its other end connected to the inductive means 14 and also is capable of being connected to one end of the gaseous discharge lamp 12.

The autotransformer preferably has a turns ratio between the primary and secondary of 25:1. Preferably, the inductance of the primary with the secondary opened is about at least 55 microhenries, whereas, preferably the inductance of the primary with the secondary shorted is about between 8 to 15 microhenries. The self-resonant frequency of the autotransformer is about 100 kHz. By self-resonant frequency it is meant that frequency where the unloaded autotransformer has a primary driving voltage in-phase with the primary current and is basically a measure of the interwinding capacitance of the secondary. For the application envisioned for the present invention, it is preferred that the secondary winding of the autotransformer be capable of withstanding repetitively occurring 2 microsecond pulses at an amplitude of about 5500 volts peak.

The charging capacitor 22 may have a typical value of about 0.33 microfarads. The charging capacitor 22 has one end connected to the tap $20_C$ and its other end connected to the semiconductor switching device 24.

The semiconductor switching device 24 may be a sidac having a threshold or breakover value of between 105 to 125 volts with a preferred range of between 110 to 115 volts, which, when equalled or exceeded causes the sidac to be rendered conductive. The sidac 24 has one end connected to the winding $20_A$ and its other end connected to one end of the capacitor 24 forming a node therebetween to which is connected the resistor-capacitor (RC) network 26.

The other end of the RC network 26 is connected to the other end of the gaseous discharge lamp 12. The RC network 28 comprises the resistor 32 having a typical value of about 10K ohms, the resistor 34 having a typical value of about of about 3.3K ohms, and the capacitor 30 having a typical value of about 0.1 microfarads. The resistor 32 may be effectively removed from the circuit by the placement of a jumper connection between terminals 36 and 38.

OPERATION OF THE STARTING AID

When the a.c. source 16 is applied to the starting aid 18 the capacitor 22 begins to charge. When the voltage across the capacitor 22 reaches the threshold level or breakover value of the sidac 24 such as 110 volts, the sidac is rendered conductive causing the energy stored in the capacitor to be discharged into the secondary winding $20_B$ of the autotransformer 20, which, in turn, causes a high voltage signal or pulse in the order of 5500 volts peak at a duration of about 2 microseconds to be developed and applied to the gaseous discharge lamp so as to initiate the starting thereof.

Figure 2:
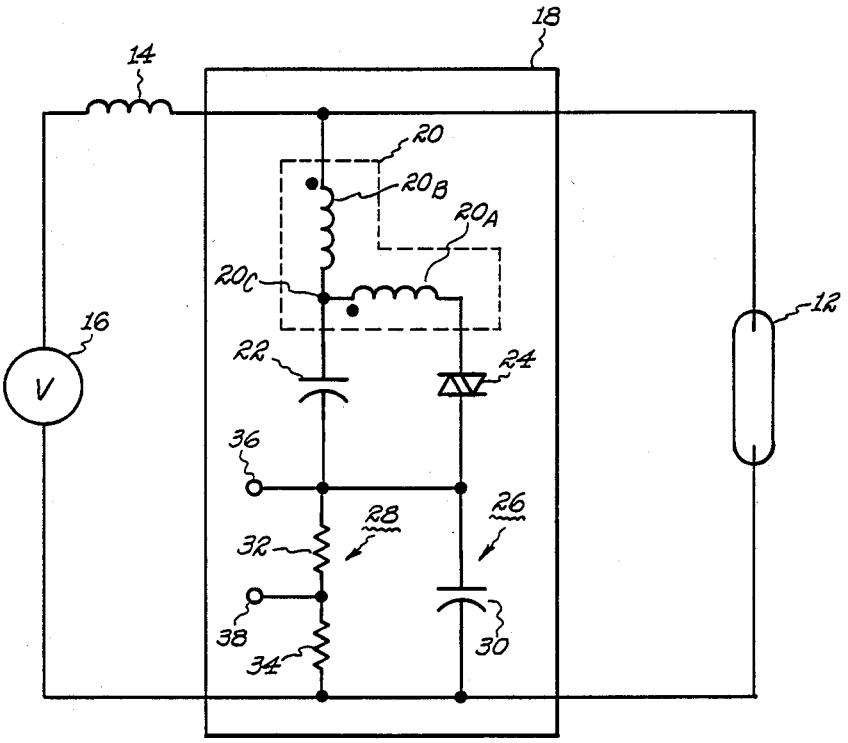
FIG. 2 is a schematic of the starting aid of the present invention.

It is contemplated that the practice of the present invention serves the needs of various gaseous discharge lamps such as low and high pressure sodium lamps along with metal halide lamps. The embodiment shown in FIG. 2 is related to high pressure sodium lamps with operating voltages of 55 volts or 100 volts which respectively correspond to open circuit voltages (OCV) of the starting aid 18 when subjected to an a.c. source 16 of 120 volts or 208 volts. For the 120 volt applications, a jumper is connected between terminals 36 and 38, whereas, for 208 volt applications the jumper is removed. For metal halide lamps the OCV is generally higher and the resistor and capacitor values for R-C network 26 may be different but the previously given values of these components may serve the needed function provided by starting aid 18.

As seen in FIGS. 1 and 2, the starting aid 18 is arranged in a parallel manner relative to lamp 12. This parallel arrangement has an advantage over a serial arrangement of a starting aid 18 with a lamp 12 in that the parallel arrangement reduces the necessary current carrying capability of the starting aid 18. In addition to the apparent reduction in the cost of its components, the parallel arranged starting aid 18 is also devoid of a pulse transformer having the inherent disadvantages discussed in the "background" section. The starting aid 18 is comprised of the autotransformer in which the primary and secondary winds have part or all of their turns in common thereby preventing the secondary winding and its related impedance from being loaded down by the primary winding and its related impedance as may occur in typical pulse transformers utilize in prior art starting aids.

It should now be appreciated that the practice of the present invention provides a starting aid having reduced current carrying capabilities by being arranged in parallel with a gaseous discharge tube while at the same time not having the inherent disadvantages contributed to starting aids utilizing pulse transformers. It should be further appreciated, that the starting aid of the present invention provides means, such as an appropriate jumper, so as to easily adapt the parameters of the starting aid to various types of gaseous discharge lamps.

What I claim as new and desire to secure by Letters Patent of the United States is:

1. A starting aid for a gaseous discharge lamp which has one end connected to an inductive means having one end connected to one end of a source of alternating current (a.c.), said gaseous discharge lamp having its other end connected to the other end of said source of a.c., said starting aid connected across said gaseous discharge lamp and comprising;

(a) an autotransformer having a first and a second serially arranged winding each having a respective first end connected to a tap, said second winding having its second end connected to the other end of said inductance means and also connected to one said end of said gaseous discharge lamp;

(b) a charging capacitor having one end connected to said tap;

(c) a semiconductor device having a voltage threshold value which when said voltage is applied across said device and said threshold value is equalled or exceeded said semiconductor device is rendered conductive, said semiconductor device having one end connected to a second end of said first winding and its other end connected to the other end of said charging capacitor forming a node therebetween;

(d) a resistor-capacitor network having one end connected to said node and its other end connected to said other end of said gaseous discharge lamp, said resistor-capacitor network comprising;

($d_i$) a selectable resistor network; and ($d_{ii}$) a capacitor arranged across said selectable resistor network.

2. A starting circuit for a gaseous discharge lamp according to claim 1 wherein;

said charging capacitor has a value of about 0.33 microfarads;

said selectable resistor network having resistance values in the range of about 3.3K ohms to about 13.3K ohms; and said capacitor arranged across said selectable resistor network having a value of about 0.1 microfarads.

* * * * *

UNITED STATES PATENT AND TRADEMARK OFFICE

CERTIFICATE OF CORRECTION

PATENT NO. : 4,916,364

DATED : April 10, 1990

INVENTOR(S) : Byron R. Collins

It is certified that error appears in the above-identified patent and that said Letters Patent is hereby corrected as shown below:

Title page, item [75] should read:

Inventors: Byron R. Collins, Hendersonville,
David W. Knoble, East Flat Rock,
both of North Carolina.

Signed and Sealed this

Nineteenth Day of March, 1991

*Attest:*

HARRY F. MANBECK, JR.

*Attesting Officer*

*Commissioner of Patents and Trademarks*